United States Patent [19]

Fletcher

[11] 4,092,021

[45] May 30, 1978

[54] UNFUSED IMAGE TRANSPORT

[75] Inventor: Gerald M. Fletcher, Pittsford, N.Y.

[73] Assignee: Xerox Corporation, Stamford, Conn.

[21] Appl. No.: 792,950

[22] Filed: May 2, 1977

[51] Int. Cl.[2] ..... B65H 29/54

[52] U.S. Cl. ..... 271/176; 271/183; 271/194; 271/DIG. 2; 118/60; 355/3 R; 432/60

[58] Field of Search ..... 271/176, 174, 183, 194, 271/DIG. 2, 80; 118/60; 432/60; 355/3 R

[56] References Cited

U.S. PATENT DOCUMENTS

| | | | |
|---|---|---|---|
| 3,804,401 | 4/1974 | Stange | 271/DIG. 2 |
| 4,017,065 | 4/1977 | Poehlein | 271/DIG. 2 |
| 4,034,977 | 7/1977 | Jahn | 271/174 |

*Primary Examiner*—Richard A. Schacher

[57] ABSTRACT

In an electrostatographic copier in which a copy member bearing an unfused and electrically disturbable image is transported on a conductive vacuum guide member and then removed from the conductive guide member, the improvement wherein a smooth conductive baffle is electrically connected and sufficiently closely spaced from said guide member to provide a low electrostatic field zone between the baffle and the guide member for the movement therebetween of the copy member, and its removal from the guide member without electrical disturbance of the image, wherein the opposing baffle and guide member have similar and opposite diverging radii of curvature in the copy removal area. Means for automatically moving the baffle in coordination with the movement of said copy member are also shown.

14 Claims, 2 Drawing Figures

UNFUSED IMAGE TRANSPORT

SUMMARY AND BACKGROUND OF THE INVENTION

The present invention relates to an improvement in copying apparatus for the transport of an image support member with an unfused electrically disturbable image thereon.

In a transfer electrostatographic process such as conventional transfer xerography, in which an image pattern of dry particulate unfused toner material is electrostatically transferred to a final image support surface (the copy sheet) from an initial image support surface (the charged photoreceptor surface developed with toner), the transferred toner is typically only loosely adhered to the final support surface and is easily mechanically and electrically disturbed by the subsequent necessary process of stripping the final support surface away from the initial support surface and transporting it to a toner fuser. The copy sheets themselves are thin, relatively delicate and may be highly variable in condition, humidity, material, weight, etc..

In xerography, the toner image transfer is most commonly achieved by electrostatic force fields created by D.C. charges applied to or adjacent the back of the copy sheet while the front side of the copy sheet contacts the toner bearing photoreceptor surface. These transfer fields must be sufficient to overcome the forces holding the toner onto the photoreceptor and to attract a substantial portion of the toner onto the copy sheet. The transfer fields are generally provided in one or two well known ways; by ion emission of D.C. charges, from a transfer corona generator, deposited onto the back of the copy paper, or by a D.C. biased transfer roller or belt rolling along the back of the paper, and holding it against the photoreceptor. In either case the copy sheet must be held in registration with, and moved together with, the imaging surface in order to transfer a registered and unsmeared image. Particularly in the conventional transfer accomplished by D.C. corona charges applied to the back of the copy sheet, these transfer charges also provide a substantial "tacking" force which electrostatically holds the copy sheet down against the imaging surface for the movement of the copy sheet therewith. This electrostatic transfer charge typically remains, in part, on the copy sheet after it is stripped.

The present invention is particularly suitable for a stripped copy sheet vacuum transport system of the type disclosed in U.S. Pat. No. 4,017,065, issued Apr. 12, 1977, to R. Poehlein, and U.S. Pat. No. 3,578,859, issued May 18, 1971, to W. K. Stillings.

Accordingly, the present specification is based on, and incorporates by reference under MPEP S608.01(p) p. 48.3, the specification of said U.S. Pat. No. 4,017,065 as a part of this specification.

Desirably included in the present system is a detacking corotron taught in U.S. Pat. No. 3,870,515, issued Mar. 11, 1975, to Norbett H. Kaupp as well as in the above-cited Poehlein patent. This system utilizes a detacking or transfer charge neutralizing corona generator to remove most of the tacking charge. However, it is not desirable to remove all of the transfer charge on the copy sheet to aid in stripping, since that may also reduce the electrostatic retention of the toner image to the copy sheet.

The Poehlein patent incorporated herein describes the vacuum manifold sheet guide system shown in the present drawings forming a part of the stripping system after stripping of the lead edge has been initiated and providing the transport of the unfused toner image bearing copy sheets.

The present invention is directed to the solution of a particular problem in the transportation of the copying member bearing the unfused and electrically disturbable image thereon. Toner disturbances have been noted which are apparently due to air ionization between the copy sheet and its post-stripping vacuum manifold transport, after it has been stripped from the photoreceptor. This breakdown is believed to occur from sharp edges or discontinuities in the conductive copy guide manifold, particularly at its downstream end where the copy sheet departs from this conductive paper guide. These electrical toner disturbances can seriously undesirably affect the image before it can be fused, under certain conditions.

The present disclosed system provides an opposing electrically biased or grounded conductive baffle closely spaced from the conductive surface of the vacuum manifold in the areas where toner disturbances have been a problem. As shown in the embodiment herein, in the paper path after the copy sheet has been stripped from the photoreceptor, and before the toner is fused, the copy sheet is transported between two closely spaced conductive surfaces. This second conductive surface or baffle is preferably smoothly curved away from the vacuum manifold at the downstream end of the vacuum manifold.

STATEMENT OF ART

Examples of art relating to electrically grounded vacuum transports for unfused toner image bearing copy sheets include the above-cited U.S. Pat. No. 4,017,065, issued Apr. 12, 1977 to R. Poehlein; and 3,578,859, issued May 18, 1971, to W. K. Stillings.

It is well known to utilize spaced paper baffles or guides in a copier for transporting copy sheets with fused, or no, toner images, e.g., U.S. Pat. No. 3,620,615, issued Nov. 16, 1971, to S. W. Volkers. It is also known to electrically bias or ground various elements of a copier, including those in the paper path, for different purposes, as taught in the Volkers patent or in pending application 626,888, filed Oct. 29, 1975, by S. Borostyan, or in U.S. Pat. Nos. 3,850,519, issued Nov. 26, 1974 to D. Weikel, 3,994,579, issued Nov. 30, 1976 to K. Iyer, 3,950,680, issued Apr. 13, 1976, to T. B. Michaels, et al., and 3,685,898, issued Aug. 22, 1972, to R. Gonzalez, and 3,508,824, issued Apr. 28, 1970 to R. Leinbach, et al.. The Gonzalez and Leinbach patents are of particular interest as guides for a copy sheet with an unfused xerographic toner image thereon. U.S. Pat. No. 2,573,881, issued Nov. 6, 1971 to L. Walkup teaches a biased development electrode.

U.S. Pat. No. 3,832,053, issued Aug. 27, 1974, to N. Goel, et al. at FIG. 3, and Col. 8 is of interest in regard to an A.C. neutralizing corona generator 74 acting on a copy sheet bearing an unfused toner image to neutralize any charges on the sheet and prevent toner disruptions from air breakdown due to stripping the copy sheet from its transport belt 52 prior to its being fused. Thus, this patent represents a recognition of the above-stated problem, but utilizes a different solution. In contrast, the present invention is specifically directed to an arrangement for the transport of unfused toner images without electrical disturbance which does not require any additional corona generators or power supplies therefor, and does not require neutralizing the charges on the copy sheet or the image thereon.

BRIEF DESCRIPTION OF THE DRAWINGS

Further objects, features and advantages of the present invention pertain to the particular apparatus and steps whereby the above-mentioned aspects of the invention are obtained. Accordingly, the invention will be better understood by reference to the following description and to the drawings forming a part thereof, wherein.

DETAILED DESCRIPTION OF THE PREFERRED EMBODIMENT

Figure 1:
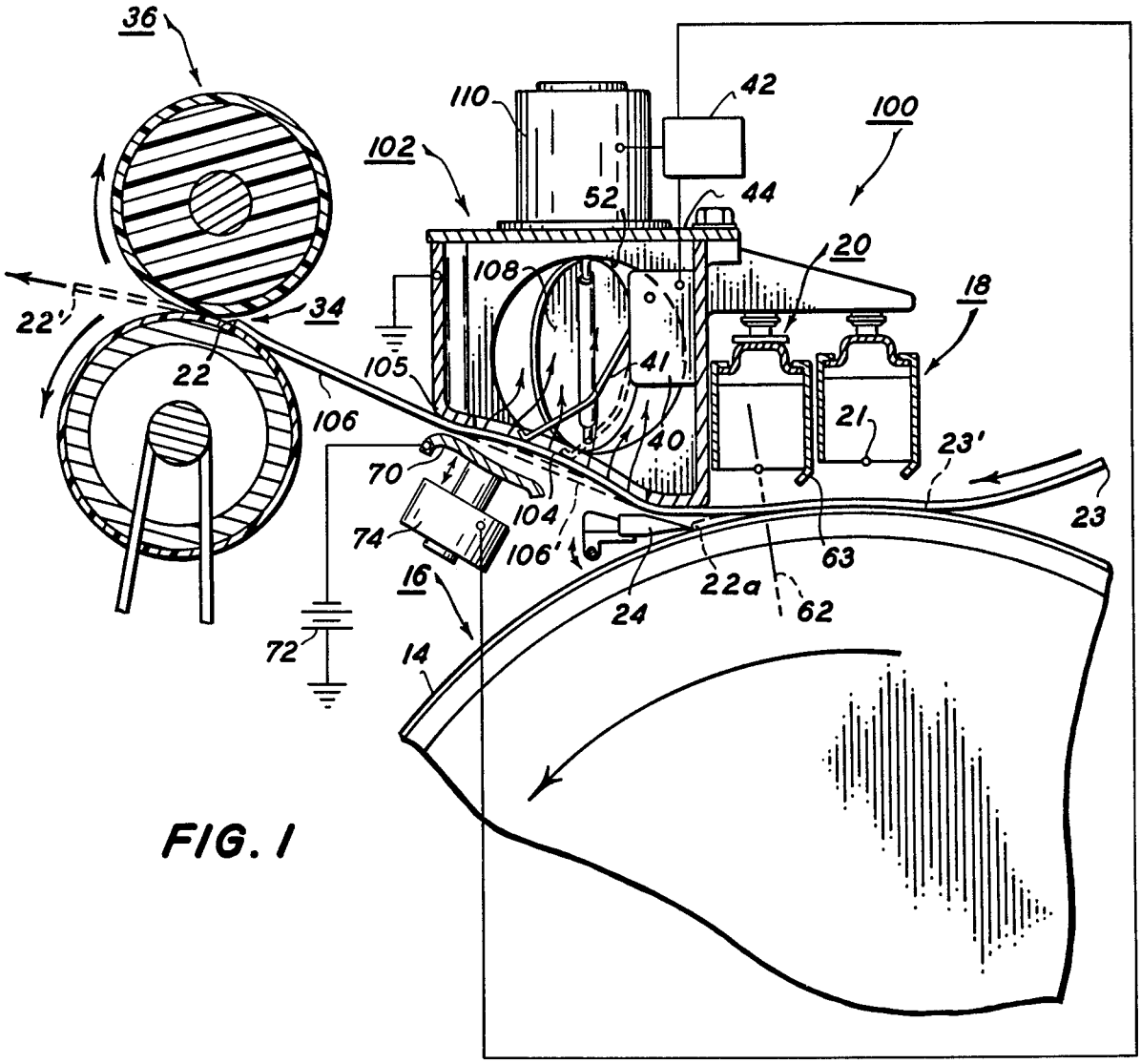
FIG. 1 is a cross-sectional side view of an exemplary xerographic copy sheet stripping, transporting and image fusing system disclosing an embodiment of the present invention, and related portions of a known xerographic copying apparatus.
Figure 2:
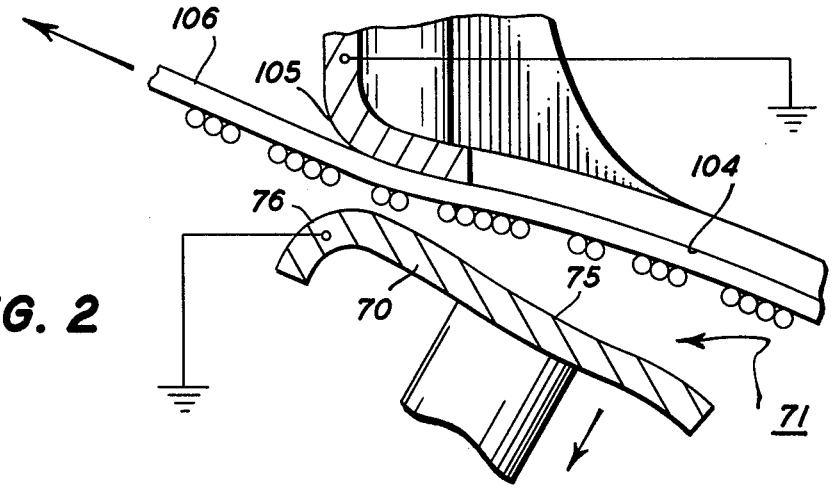
FIG. 2 is an enlarged portion of FIG. 1, but with a different electrical biasing arrangement.

FIGS. 1 and 2 illustrate two examples of the present invention. They are structurally identical, the only difference being the different electrical connection of the baffle 70, which is grounded in FIG. 2 and biased by a biasing means 72 in FIG. 1.

It will be appreciated that the subject system may be utilized with many different exemplary xerographic or other copying systems in different orientations and structures. However, the system disclosed herein is shown as a part of the exemplary copy sheet stripping and transport system 100 shown and described in the above-cited and incorporated U.S. Pat. No. 4,017,065, issued Apr. 12, 1977, R. E. Poehlein. Accordingly, in view of that incorporation by reference, and the desirable reduction in the length of this specification enabled thereby, the present description will be generally limited to those features disclosed which are unique to the present invention.

Referring first to FIG. 1, as described in said U.S. Pat. No. 4,017,065, it may be seen that a toner image is transferred to a copy sheet 106 by a transfer corona generator 18 with corona wire 21. Immediately downstream the copy sheet 106 is subjected to detacking or partial transfer charge neutralizing by a detacking corona generator 20. The copy sheet is stripped from the surface of photoreceptor 14 at position 22a by stripping finger 24, and then subsequently transported over the apertured vacuum support and guide surface 104 of vacuum manifold unit 102. The body of the copy sheet strips at position 62. The copy sheet is removed from the guide surface 104 of the vacuum manifold 102 at a removal area 105 comprising a smoothly rounded downstream corner of the vacuum manifold 102. The copy sheet 106 then enters the nip 34 of the fuser roll unit 36. The lead edge of the copy sheet 106 is shown here at 22 and the trail edge at 23. Extending through the guide surface 104 in the copy sheet path is the switch finger 41 of a sheet sensor switch 40. Its output is connected through a time delay circuit 42.

In this particular disclosed embodiment, the interior of the vacuum manifold 102 is provided with a vacuum from a conventional vacuum source through an aperture 52 in the rear thereof with a butterfly valve 108 controlled by a solenoid 110. As described in detail in the incorporated U.S. Pat. No. 4,017,065, the actuation of the valve 108 serves to control the vacuum within the manifold 102, which in turn controls the vacuum retention applied through the apertured guide surface 104 to the copy sheet 106. The system described in that patent is intended to provide a controlled variable buckle of the copy sheet 106 for speed compensation between the rotational speed of the photoreceptor drum 16 and the fuser 36.

Referring now particularly to the unique features disclosed in FIG. 1 and 2 herein, there is shown a conductive electrode plate or baffle 70 closely spaced by spacing 71 from the copy sheet guide surface 104 of the manifold 102. In FIG. 1 the baffle 70 is shown electrically biased to a negative potential by the bias means 72. The baffle 70 is biased to an electrical potential of the same polarity as that of the toner image material on the copy sheet 106 there, which is opposite to the polarity of the residual transfer charge on the copy sheet. The baffle 70 includes a generally planar portion 75 generally parallel the surface 104. It may be seen that the baffle 70 terminates at its downstream end at a curved area 76 opposite from the downstream or exit corner 105 of the manifold 102. The baffle 70 smoothly curves away from the surface 104 at this curved area 76.

The baffle 70 here is sufficiently closely spaced from the copy sheet vacuum guide surface 104 and electrically connected, either to the bias 72 or grounded as in FIG. 2, so as to provide a low electrostatic field zone between the baffle 70 and the guide member 104 through which the copy member 106 may be moved. As may be particularly seen in FIG. 2, the removal area of the copy sheet 106 from the surface 104 at the corner 105 is within this low electrostatic field zone and preferably at the area of minimum spacing 71 between the baffle 70 and the surface 104. This substantially reduces the potential for electrical disturbance of the imaging material due to the separation of the copy member 106 from the guide member 104. In the region of separation, the paper is moving between two conductive surfaces sufficiently closely spaced to suppress any tendency of arcing between the charged copy sheet and the surface 104 on which the copy sheet is being transported when the copy sheet separates from the surface 104. Thus, the tendency for toner disturbances there is substantially reduced.

These opposing surfaces must be smooth in order to maintain low and gradual electrical field gradients therebetween. Thus, as shown here, both the baffle 70 and the guide member 104 extend smoothly and generally parallel one another in the direction of transport of the copy member therebetween into the removal area 105 of the copy member from the guide member 104, except only for the vacuum apertures in the guide member 104. These vacuum apertures themselves preferably have smooth rounded edges. The baffle 70 at 76, and the guide surface 104 smoothly curve away from one another in the removal area 105. These opposing or facing smooth arcuate surfaces 105 and 76 may be seen to have similar, mirror image, oppositely diverging radii of curvature in the removal area to maintain a uniform field zone in and beyond the copy sheet separation point and thereby prevents potential arcing conditions which would otherwise occur from the residual transfer charge on the copy sheet 106 and the charge of the toner image.

Where, as in the embodiment of FIG. 1, the baffle 70 is electrically biased to a polarity the same as that of the imaging material an electrical field gradient is created between the baffle and the guide member 104 which assists in the retention of the imaging material by the copy member 106 as well as aiding in the suppression of arcing by opposing part of the field gradient due to the charge on the copy sheet 106. However, this electrical biasing is not necessary for most conditions and normally the baffle 70 can be commonly electrically grounded with the guide member 104. The electrical field effect herein is somewhat similar to the effect of an electrically biased development electrode spaced from the photoreceptor in a xerographic copier which reduces the electrical field within the photoconductor which is due to the photoconductor surface charge and increases the field above the photoconductor so that the development of solid areas is improved, as disclosed in U.S. Pat. No. 2,573,881, issued Nov. 6, 1951, to L. E. Walkup, et al., cited previously.

The spacing of the baffle 70 from the guide member 104, particularly at the removal area 105, is critical. Preferably this spacing is less than approximately 6.4 millimeters. The necessary spacing will depend on the electrostatic charges on the copy sheet 106 which must be controlled. Spacings significantly greater than approximately 6.4 millimeters (approximately one-fourth inch) are effectively equivalent to no baffle, i.e., they are ineffective to significantly reduce the electrostatic field by splitting some of the field between the vacuum manifold and the baffle. A spacing between the baffle and the guide member at the removal area of less than 1.8 millimeters is preferred as providing suppression of toner disturbances under most conditions with an upstream partial transfer charge neutralizing corona generator, as here. For a baffle to guide surface spacing of less than 1.8 millimeters (i.e., less than 70 mills) toner disturbances can be essentially prevented even at low transfer currents, and can probably prevent toner disturbances even without detack. Without detack the residual paper charges will, of course, be higher than with detack. Therefore, with detack, slightly greater spacings than 1.8 millimeters would be acceptable for many systems.

The minimum spacing is a practical limitation of the spacing which will allow the passage of the copy sheet between the baffle and the paper guide without paper jamming or imaging smearing. That is, image smearing which would occur if the unfused image on the copy sheet rubbed against the baffle 70. The paper path from the copy sheet exit area of the paper guide into the fuser should preferably be as straight as possible to reduce the liklihood of such contact between the image bearing side of the copy sheet and the baffle 70.

To minimize toner smearing or toner build-up on the baffle which could decrease the gap and increase the potential smearing problems, the baffle 70 could be provided with automatic means for cleaning its surface facing the copy sheet path. That is, the baffle could be provided with movable cleaning pads or could itself comprise rotating rods or rotating surfaces engaging a cleaning pad.

Additionally, as shown in FIG. 1, is a further feature for preventing contact of the outer or unfused toner image bearing side of the copy sheet 106 with the facing surface of the baffle 70. Where the back or non-toner bearing side of the copy sheet 106 is always maintained in vacuum retention against the guide surface 104 the spacing between the baffle 70 and the guide surface 104 may be fixed. However, where a portion of the copy sheet 106 moves away from the surface 104 under certain conditions, undesirable contact could be made with a fixed baffle by the toner image on the copy sheet. This is prevented here by the illustrated movable mounting of the baffle 70 on a solenoid 74. The solenoid 74 is automatically actuated to pull the plate 70 substantially away from the copy sheet path, i.e., much further away than the above-described spacing normally desired between the baffle 70 and the manifold 102. This movement of the baffle 70 is automatically provided here in coordination with the movement of the copy member 106 therebetween. This may be accomplished by the sheet sensing switch 40 and the circuit 42 described above and in the incorporated U.S. Pat. No. 4,017,065. As further described in that patent, the system disclosed here includes means for generating a variable buckle in a portion of the copy member 106 over the guide surface 104. The solenoid 74 here operates automatically to move the baffle 70 to prevent interference with said variable buckle generation, i.e., to avoid contact with the copy member at all times. Further, the baffle 70 may be automatically moved to avoid a trail edge flipping action of the copy sheet as the trail edge 23 thereof passes the removal area 105. The baffle 70 may be automatically moved away just prior to the passage of the trail edge 23 between the baffle 70 and the surface 104. Preferably, this movement of the baffle 70 by the solenoid 74 (or a cam or other suitable mechanism) will occur only for the very trail edge area of the copy sheet, or only for any area of the copy sheet for which it is essential, since, when the plate 70 is so moved away from the surface 104, the baffle 70 is no longer effective for preventing toner disturbances in that region of the copy sheet as described above.

In conclusion, it may be seen that there has been described herein an improved means for transporting an unfused electrically disturbable toner image on a copy member with reduced potential for disturbances of that image by a simple and low cost apparatus. While the exemplary embodiments described herein are presently considered to be preferred, various other modifications or improvements will be apparent to those skilled in the art.

The following claims are intended to cover all such variations and modifications as fall within the true spirit and scope of the invention.

WHAT IS CLAIMED IS:

1. In an electrostatographic copier in which a copy member bearing an unfused and electrically disturbable image of imaging material on one side thereof is transported on a conductive vacuum guide member which vacuum engages the opposite side of said copy member and then removed from said conductive guide member at a removal area of said guide member, the improvement wherein a conductive electrostatic baffle means is electrically connected and sufficiently closely spaced from said guide member to provide a low electrostatic field zone between said baffle means and said guide member for the movement therebetween of the copy member, and wherein said removal area of said guide member is within said low electrostatic field zone to substantially reduce the potential for electrical disturbance of said imaging material from the separation of said copy member from said guide member.

2. The electrostatographic copier of claim 1, wherein said removal area of said guide member is a smooth arcuate surface curving away from said baffle means.

3. The electrostatographic copier of claim 2, wherein said baffle means smoothly curves away from said guide member at said removal area thereof.

4. The electrostatographic copier fo claim 3, wherein said baffle means and said guide member extend smoothly and generally parallel one another in the direction of transport of the copy member therebetween into said removal area of said copy member from said guide member except for vacuum apertures in said guide member.

5. The electrostatographic copier of claim 1, wherein said baffle means and said guide member extend smoothly and generally parallel one another in the direction of transport of the copy member therebetween into said removal area of said copy member from said guide member, and smoothly curve away from one another in said removal area.

6. The electrostatographic copier of claim 5, wherein said baffle means and said guide member have similar, but opposite diverging radii of curvature in said removal area.

7. The electrostatographic copier of claim 1, wherein said guide member is electrically grounded and said imaging material has an electrical charge of a given polarity, and wherein said baffle means is electrically biased to a polarity the same as that of said imaging material to create an electrical field gradient between said baffle means and said guide member to assist the retention of said imaging material by said copy member.

8. The electrostatographic copier of claim 1, wherein said baffle means and said guide member are commonly electrically grounded.

9. The electrostatographic copying system of claim 1, wherein said baffle means is spaced from said guide member at said removal area by less than approximately 6.4 millimeters.

10. The electrostatographic copying system of claim 1, wherein said baffle means is spaced from said guide member at said removal area by less than 1.8 millimeters.

11. The electrostatographic copying system of claim 1, wherein said conductive guide member is immediately downstream of an image transfer station in which the image of imaging material is transferred to the copy member and in which the copy member is subjected to a charge neutralizing corona generator to reduce electrostatic charge on said copy member.

12. The electrostatographic copying system of claim 1, further including means for automatically moving said baffle means away from said guide member in coordination with the movement of said copy member therebetween.

13. The electrostatographic copying system of claim 12, wherein said means for automatically moving said baffle means includes means for sensing the trail edge of the copy member and moving said baffle means away from said guide member prior to the passage of said trail edge therebetween.

14. The electrostatographic copying system of claim 12, wherein said guide member includes means for generating a variable buckle in said copy member and said means for moving said baffle means operates to avoid contact between said copy member and said baffle means and to prevent interference with said variable buckle generating means.

* * * * *